United States Patent [19]

Doak

[11] Patent Number: 4,582,226

[45] Date of Patent: Apr. 15, 1986

[54] SANITIZING A DRINK SUPPLY SYSTEM

[76] Inventor: Gerald Doak, Box 34, Group 105, R.R. #1C, Winnipeg, Manitoba, Canada, R3C 2E4

[21] Appl. No.: 656,239

[22] Filed: Oct. 1, 1984

[30] Foreign Application Priority Data

Jan. 13, 1984 [CA] Canada ..... 445324

[51] Int. Cl.[4] ..... B67D 1/08

[52] U.S. Cl. ..... 222/148; 222/129.1; 137/240

[58] Field of Search ..... 222/148, 129.1; 137/238, 240, 561 A, 597; 134/22.12; 285/132, 150

[56] References Cited

FOREIGN PATENT DOCUMENTS 983661 2/1976 Canada .

1150045 4/1969 United Kingdom ..... 134/22.12

1322755 7/1973 United Kingdom ..... 134/22.12

*Primary Examiner*—Joseph J. Rolla

*Assistant Examiner*—Nils E. Pederson

*Attorney, Agent, or Firm*—Stanley G. Ade

[57] ABSTRACT

A system for sanitizing a drinks dispensing apparatus includes a permanently attached manifold device mounted adjacent the product supply containers. The manifold device comprises a first manifold which can be attached to each of the product supply lines and two other manifolds one of which can be permanently attached to a gas supply and the other to a water or soda water supply. The first manifold also includes a hose and cooperating coupling which can be connected in turn to the gas manifold for dispensing the product within the supply lines, secondly to a tank of sanitizing fluid, thirdly to the water manifold and fourthly back to the gas manifold.

16 Claims, 4 Drawing Figures

SANITIZING A DRINK SUPPLY SYSTEM

BACKGROUND OF THE INVENTION

This invention relates to a method of sanitizing a drink supply system, a drink supply apparatus particularly adapted to use the method and to a manifold device which is also particularly adapted for use in the method and for use in the drink supply apparatus.

The dispensing of soft drinks and beer generally involves a dispensing head with suitable valves for dispensing a measured quantity of the drink and supply containers which are connected to the dispensing head by supply lines. As the dispensing head is often situated in a customer service area and the supply containers in a storage area there is often a fairly long length of the supply lines or hoses interconnecting the two.

The sanitizing of this equipment has of course long been known and is an essential requirement to avoid the build up of harmful bacteria which can develop particularly in the syrup supply lines of the post-mix dispensing type but also in the premixed type and also in the beer dispensing type. Conventionally however this sanitizing has been carried out irregularly and by service personnel who visit the premises especially to carry out the service and sanitizing procedure. This has meant that sanitizing has been looked upon as an inconvenience which must be suffered as infrequently as possible. This situation is however unsatisfactory to the consuming public.

Recent studies have however shown that not only can regular sanitizing be beneficial to the consuming public, it can also have economic advantages to the equipment user. This applies particularly in the post-mix syrup type dispensing equipment in which syrup is dispensed from the product containers under pressure from a carbon dioxide supply line and is at the dispensing head mixed with soda water to obtain the desired flavoured drink.

As time elapses after a previous sanitizing process, bacteria build up in the supply lines and in the dispensing head growing on the sugar filled syrup in the well known exponential manner. This growth leads to the development of what is known as black mold which apart from its unsavoury characteristics also tends to plug up valves and openings in the dispensing system. The post-mix dispensing system is particularly dependent upon the supply at the correct desired rate of the syrup into the soda water and this can be adjusted so that the syrup passes through small holes to mix thoroughly with the soda water. As the holes tend to plug up the mix varies and the user of the equipment has to adjust the mix manually to obtain a satisfactory tasting drink. The user thus manually compensates for the plugging of the small openings and generally tends to overcompensate thus increasing the amount of syrup used in any particular drink. This variation is not only unsatisfactory to the customer but also equally importantly can substantially increase the amount of syrup used in the drink.

In one study recently carried out by ensuring that the blockages do not occur and thus taking away the manual variation in the mix of syrup and water the number of drinks from a five gallon container of the supply syrup was increased from 250 to 400 thus substantially increasing the profit on a container or in other words reducing the costs of the operator.

Methods for sanitizing apparatus of this type are described and shown in my prior Canadian patent No. 983,661 and my prior U.S. Pat. No. 3,945,536. However both of these techniques require the attendance of a service engineer to bring with him the necessary equipment and to carry out the sanitizing of the dispensing system. These methods while providing a satisfactory method of sanitizing are disadvantageous in that the visit of the service engineer may not be sufficiently regular, is costly and is also inconvenient that the dispensing equipment must be shut down for the period of the visit.

SUMMARY OF THE INVENTION

It is one object, therefore, of the present invention to provide a method of sanitizing equipment of this type, a drink dispensing apparatus of this type and also a manifold device all of which allow the sanitizing to be carried out by on-site personnel in an efficient, simple and effective manner.

According to a first aspect of the invention, therefore, there is provided a method of sanitizing a drink supply system of the type including a plurality of product supply containers, means for dispensing the product from the supply containers in measured amounts and a plurality of supply lines each connecting a respective one of the containers to said dispensing means, the method comprising disconnecting each said supply line from said container and connecting said line to a manifold, connecting said manifold to a supply of compressed gas, dispensing the product in said lines from said dispensing means in said measured amounts, disconnecting said manifold from said compressed gas supply and connecting said manifold to a supply of sanitizing fluid, discharging said sanitizing fluid through said lines and said dispensing means, disconnecting said manifold from said sanitizing fluid supply and connecting said manifold to a water supply, discharging said water through said lines and said dispensing means, disconnecting said manifold from said water supply and connecting said manifold to said compressed gas supply, discharging compressed gas through said lines and said dispensing means and reconnecting each said supply line to said container.

According to a second aspect of the invention there is provided a manifold device for use in sanitizing a drink supply system comprising a support member, means for attaching said support member to a support, a manifold carried by said support member and including a plurality of quick release couplings each for receiving a cooperating coupling of a supply hose, a hose with one end thereof connected to said manifold, a cooperating coupling mounted on the other end of the hose, and a pair of quick release couplings mounted on said support member separate from said manifold, each connected to a hose connector for receiving the end of a supply hose and each arranged to cooperate with the cooperating coupling on the other end of the hose.

According to a third aspect of the invention there is provided a drink dispensing apparatus comprising means for dispensing product in measured amounts, from a plurality of product supply containers, a plurality of supply lines each for connecting said dispensing means to a product supply container and a manifold device for use in sanitizing the dispensing means and the supply lines, the manifold device comprising a manifold permanently attached to a support member adjacent the supply lines and including a plurality of quick release couplings each for receiving a cooperating coupling of a supply line, a hose with one end thereof connected to said manifold, a cooperating coupling mounted on the other end of the hose, and a pair of quick release couplings mounted on said support separate from said manifold, each connected to a hose connector for receiving the end of a supply hose and each arranged to cooperate with the cooperating coupling on the other end of the hose.

It is one advantage of the invention, therefore, that the device comprises a simple support for a manifold and for the additional supply line couplings which can be simply attached to a surface for example the wall adjacent the supply containers. The device can therefore be maintained permanently on location. The hose connected to the manifold can simply be connected to the carbon dioxide supply attached to the support member or to the water supply or to the sanitizing fluid supply which will generally be in a container of the same sort as the syrup containers.

The on-site personnel can therefore follow the simple instructions to carry out the sanitizing process on a regular basis under the direct control of the operator of the site.

Furthermore the fact that the operation can be carried out by on-site personnel means that the operator can connect the gas line to the product supply lines through the manifold and dispense the liquid through the dispensing head so that it can be sold rather than wasted as is required in the current systems.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
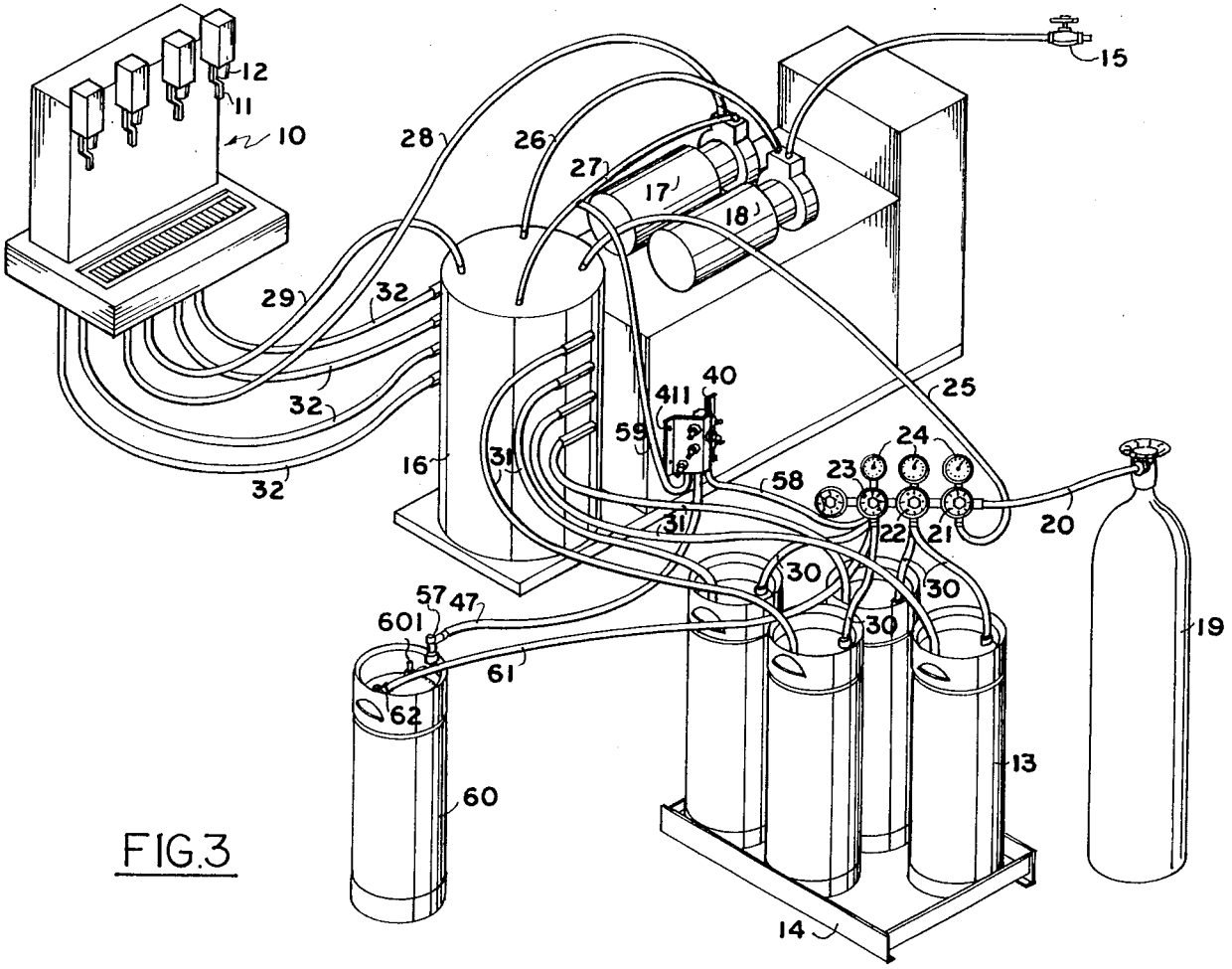
FIG. 3 is a schematic assembly view of a soft drink dispensing system including the manifold device of FIGS. 1 and 2.

Turning firstly to FIG. 3 which illustrates a soft drink dispensing system, the system comprises a conventional dispensing head schematically indicated at 10 which provides four valve arrangements 11 and four dispensing nozzles 12 each for dispensing one of four separate flavours of soft drink. The dispensing head is of the post-mixed type in which flavouring in the form of syrup is delivered to the dispensing nozzle through small jet orifices which combine the syrup with a soda water supply. The jet orifices act to mix the syrup in the soda water as the drink is dispensed through the nozzle 12. The details of an arrangement of this type are well known to one skilled in the art and of a conventional form and therefore are not described fully herein.

The supply of syrup for each of the nozzles 12 is contained in a separate container 13 which is typically positioned in a storage area remote from the dispensing head. As shown the containers 13 are mounted on a platform 14 in a common area closely adjacent one another for attachment to the various supply and feed lines as will be explained hereinafter.

A water supply is indicated at 15 for supplying water to the dispensing head 10 for mixing into the drinks. A cooling tank 16 again of conventional form is connected into the system to cool the liquids passing through the various supply lines so that the drinks when dispensed are cooled containing both cooled syrup and cooled soda water.

A pair of pumps 17 and 18 act to pump the water supply as will be explained. Finally a gas tank 19 is connected into the system to supply pressurized gas preferably $CO_2$ for driving the feed of product and for carbonating the water to form soda water.

The tank 19 is connected via feed line 20 to three valves 21, 22, 23 which act to regulate the gas supply from the tank 19 and include pressure meters 24 for visually setting the required pressure at the valve. A first line 25 from the valve 21 is communicated to the tank 16. The line 25 therefore supplies carbon dioxide to the cooling tank 16 in which it is combined with water supplied from the supply 15 and pumped by the pump 18 through a line 26 so that the lines 25 and 26 fill a container within the cooling tank 16 with carbonated water or soda water for feeding to the dispensing head 10. The second pump 17 acts to draw soda water from the container within the tank 16 through a line 27 and to continually circulate the soda water through a line 28 to the distributing head from which it is returned to the container within the tank 16 through a line 29. Thus cooled soda water continually circulates from the container 16 to the dispensing head through the pump 17 and is retained cooled to avoid warming of soda water in standing lines. When a drink is dispensed from the dispensing head 10 it is extracted from the lines 28 and 29 under pressure from the pump 17 following in which the circulation is recommenced.

The valves 22, 23 are connected through lines 30 to the supply containers 13 for pressurizing the containers so that syrup within the containers can be dispensed through lines 31 which lead eventually to the dispensing head 10. The lines 31 also pass through the cooling tank 16 so the syrup also is cooled from which it passes to the dispensing head 10 through lines 32. The syrup is not however circulated and merely rests in the standing lines 31 and 32.

Thus when one of the valves 11 is operated to dispense drinks from the dispensing head 10 soda water is extracted from the lines 28, 29 and syrup is extracted from one of the lines 32 under pressure from the $CO_2$ supply from the tank 19. All of this arrangement is conventional and is well known to those skilled in the art.

Figure 1:
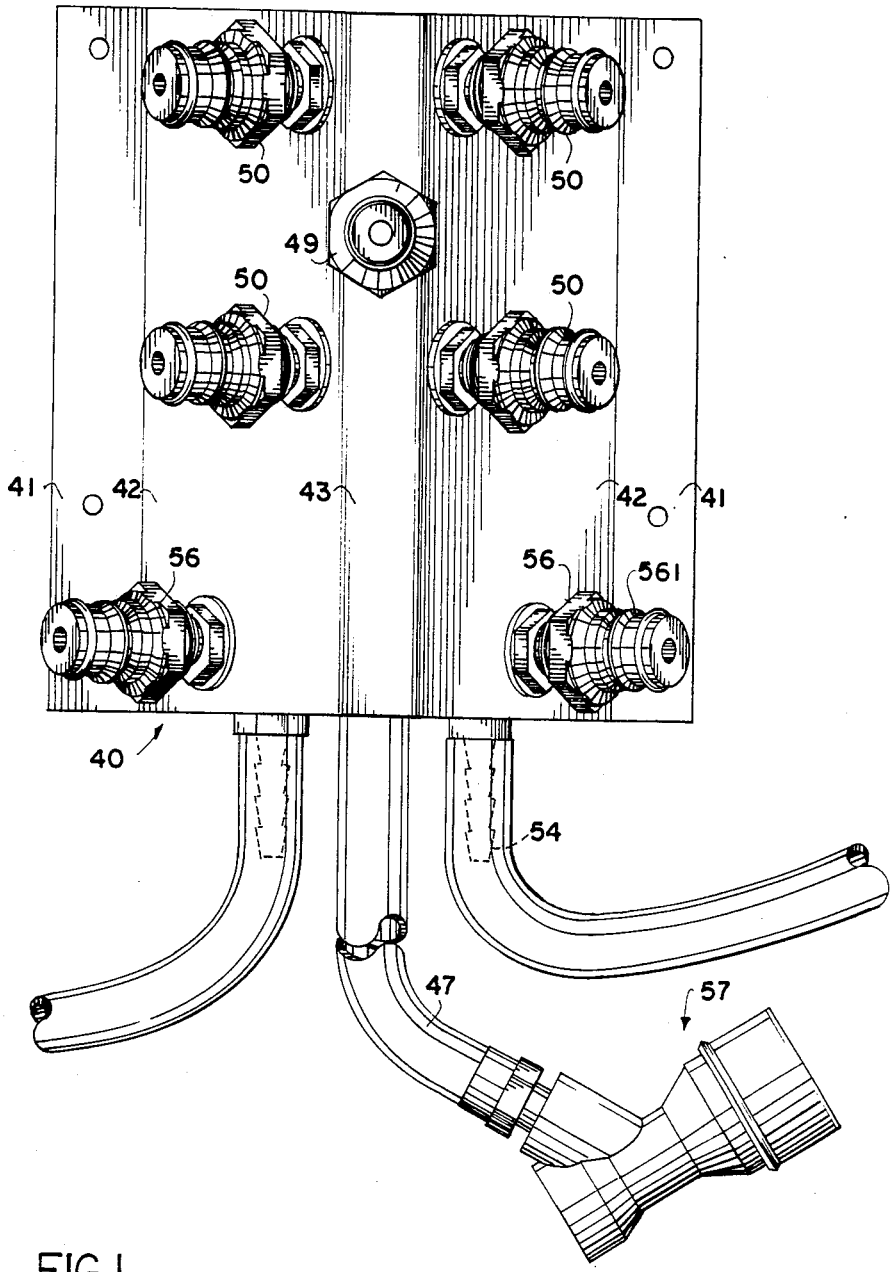
FIG. 1 is a front elevational view of a manifold device for use in a soft drink dispensing machine.
Figure 2:
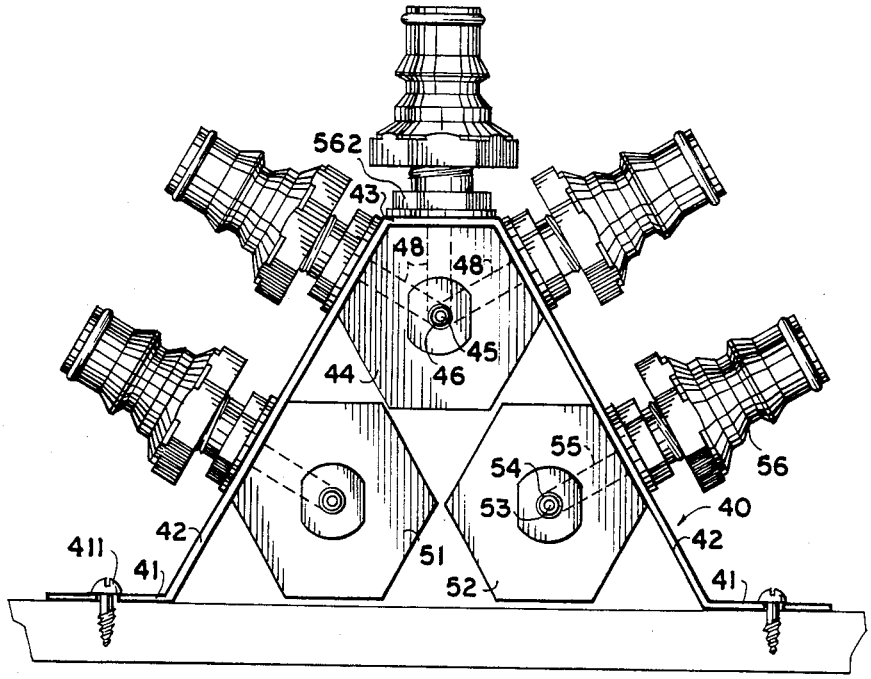
FIG. 2 is a bottom plan view of the manifold device of FIG. 1.

Turning now to FIGS. 1 and 2 there is shown a manifold device for use in sanitizing the above described drinks dispensing system. The device comprises a sheet metal support and cover indicated at 40 which as shown in FIG. 2 comprises a first pair of coplanar flanges 41 for attachment to a planar surface which can be a wall or other mounting device as shown in FIG. 3. The cover plate 40 is then from the flanges 41 bent inwardly at an angle of 60° to form two surfaces 42 which extend away from the wall or planar surface and inwardly at an angle of 60° to the planar wall. Finally a narrow surface 43 parallel to the flanges 41 interconnects the two walls 42.

The cover plate 40 supports a first manifold 44 which has a hexagonal external cross section with the width of one face corresponding to that of the wall 43 so that three hexagonal faces fit within the walls 42 and the wall 43. Axially of the manifold 44 is provided a duct 45 which is attached at one end to a hose spigot 46 extending downwardly from the end of the manifold for connection to a hose 47. The duct 45 connects with outwardly extending ducts 48 each of which is arranged at right angles to a face of the hexagonal outer surface. The forwardly facing surface of the hexagonal manifold 44 has one channel 48 for connection to a quick release connector 49 which thus projects at right angles away from the surface 43. Each of the two side faces of the manifold 44 has two such ducts 48 spaced apart for connection to further quick release connectors 50 which extends from the surfaces 42 at right angles thereto. It will be noted that the connector 49 is positioned intermediate the connectors 50. Furthermore the connectors all extend away from the wall parallel to the flanges 41 so that all of the connectors are readily accessible for receiving a cooperating connector of a hose line. More particularly the connector 49 extends at right angles away from the wall and lies at 60° to the connectors 50 which in turn are inclined to the wall at an angle of 30°.

The manifold device further includes two additional manifolds 51 and 52 which similarly are formed with hexagonal outer surfaces. Each of the manifolds 51, 52 includes, similarly to the manifold 44, an axially extending duct 53 which connects at one end to a spigot 54 and to a radially extending duct 55 which connects to a quick release connector 56. The position of the quick release connectors 56 on the surfaces 42 lies closer the respective flange 41 than does the position of the connectors 50 in view of the position of the manifolds 51, 52 rearwardly of the surfaces 42. However again the connectors 56 are readily available and accessible for receiving a hose connector.

A cooperating hose connector is shown attached to the line 47 indicated at 57. The details of the quick release connectors 49, 50, 56 and the cooperating connectors 57 are known to one skilled in the art and therefore will not be described in detail, except to note that the quick release connectors 49, 50, 56 are each slightly modified so that each will receive a conventional cooperating connector from either a product supply line or a gas supply line.

As is known manufacturers of this equipment differentiate the connectors firstly in that the ridge indicated at 561 is for a product line slightly greater in diameter than that for a gas line. Secondly the screw threads by which the connector is coupled to a support is different in the two cases. For the present invention a quick release connector which can be used for either gas or product has been designed by providing a universal thread which can accommodate either type and also by slightly reducing the height or diameter of the ridge 561 so that it can receive a gas line coupling.

As shown in FIG. 2, the coupling itself is indicated at 56 and this is mounted on the manifold via a connector 562 which includes a male screw thread for attachment to the manifold device 44 and a male screw thread for attachment to the connector 49, 50 or 56. Suitable sealing rings can be provided as will be known to one skilled in the art. In addition the connectors 49, 50, 56 all include a poppet-type valve which normally seals the connector so that no gas or product can escape but can be depressed by a pin within the cooperating coupling to allow communication of the product or gas from the connector to the coupling or vice versa.

Turning again to FIG. 3, the manifold device is shown attached to the wall adjacent the valves 21, 22, 23. However it will be appreciated that the exact location can be altered in accordance with the layout and any suitable surface can be employed.

The cover plate 40 is permanently attached to the wall or other surface by screws 411. Furthermore the manifold device is permanently connected so that the spigot 54 of the manifold 52 is permanently connected by a line 58 to the gas supply as provided by a T coupling from a line 30. In addition the spigot 54 of the manifold 51 is permanently connected to a soda water supply via a line 59 coupled by a T fitting to the line 27 to the recirculating pump 17. Thus the quick release couplings 56 provide a permanent supply of carbon dioxide and soda water at the manifold device.

The sanitizing device further includes a sanitizing tank 60 which can be of the same form as a syrup supply tank 13. This tank can be permanently connected via a hose 61 to a $CO_2$ supply through a further T fitting to a line 30. A valve 62 on the line 61 allows the gas supply to be turned off so that the sanitizing tank can be filled with a sanitizing liquid for example chlorine.

The sanitizing equipment is therefore always permanently on site and can be used in a sanitizing process at any convenient time under the control of the on-site personnel. The sanitizing can therefore be carried out at regular intervals without waiting for the arrival of a service engineer and without interfering with the normal dispensing of drinks.

In the process the following steps are carried out.

1. The lines 31 are disconnected from the product supply tanks 13 by the conventional quick release couplings and the cooperating connector attached to the line 31 is then attached to one of the quick release couplings 49, 50.

For convenience the quick release couplings 49, 50 can carry or have adjacent thereto on the cover plate 40 a respective indication of the product concerned so that the user can ensure that a line 31 disconnected from a particular tank 13 is coupled to one of the connectors 49, 50 and then returned to the same tank without room for any error.

2. With the lines 31 now coupled to the manifold 44, the cooperating coupling 57 of the line 47 at the end of the manifold 44 is firstly connected to the coupling 56 of the manifold 52, that is, the carbon dioxide supply. In this position carbon dioxide under pressure is supplied to each of the lines 31 so that the syrup in the lines 31 and 32 can continue to be dispensed in the measured amounts through the nozzles 12 of the dispensing head 10. In normal practice, therefore, the user can continue to sell the product thus avoiding any wastage and reducing to a minimum the down time of the dispensing head.
3. When the product has been dispensed from the lines 31 and 32, the coupling 57 is then removed from the manifold 52 and is moved to the dispensing nozzle indicated at 601 of the sanitizing tank. The valves 11 are then opened so that sanitizing fluid is fed into the lines 31 and 32 under pressure from the carbon dioxide supply.

4. When sufficient sanitizing fluid has been passed through the lines and after waiting a sufficient period of time to ensure that proper sanitizing has taken place, the connector 57 is disconnected from the coupling 601 and is placed on the coupling 56 of the manifold 51, that is the water supply. The valves 11 again are opened to allow soda water to be dispensed through the lines 31 and 32 to clear the sanitizing fluid from the lines. Soda water is particularly effective in view of its low pH.
5. After washing for a satisfactory period of time, the connector 57 is returned to the first connector 56 of the manifold 52 to feed carbon dioxide through the lines to expell all remaining soda water and to dry the lines for receipt of further syrup.
6. The cooperating couplings of the lines 31 are then returned to the respective product supply tank 13.

Figure 4:
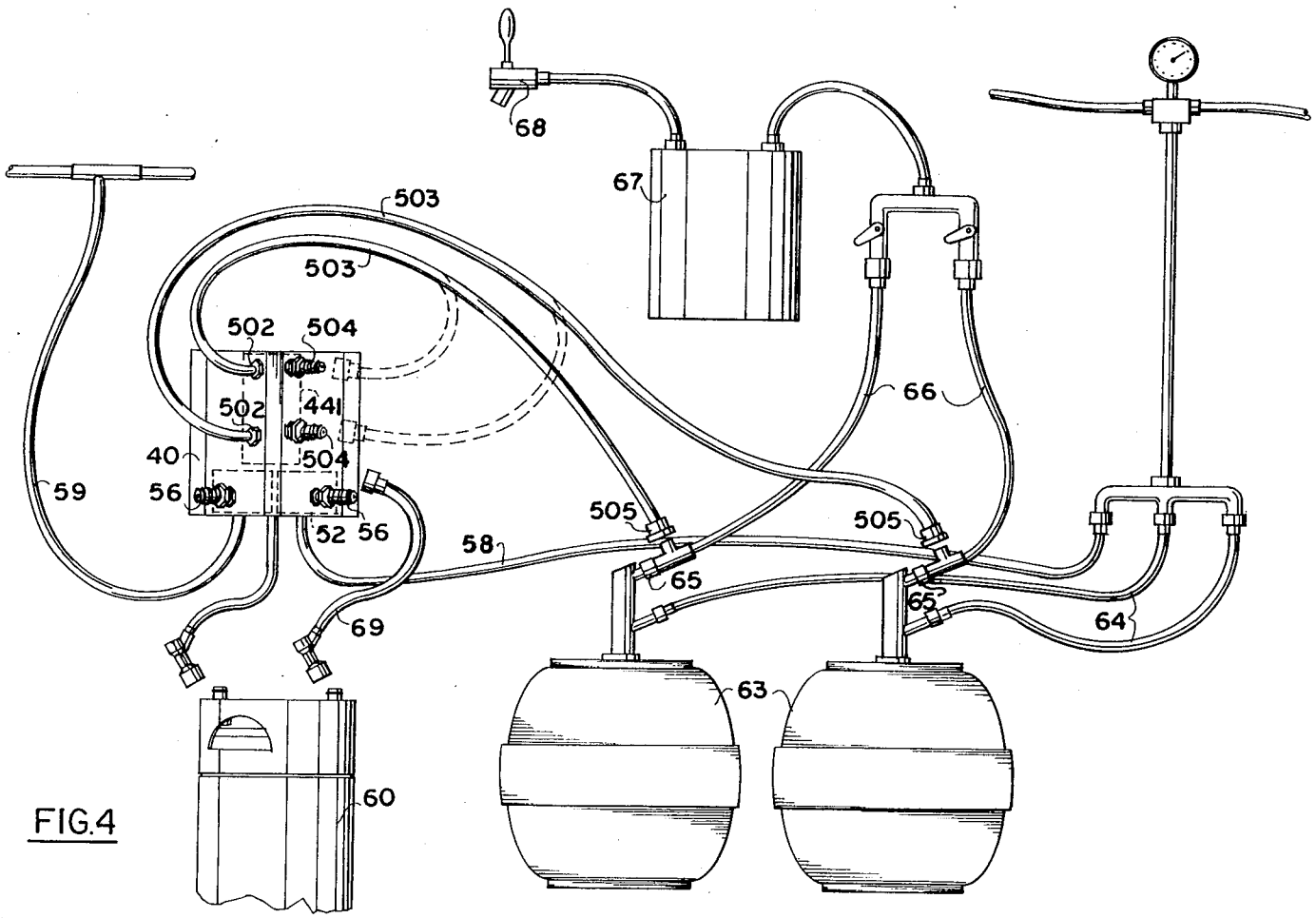
FIG. 4 is a schematic assembly view of a beer dispensing system incorporting a manifold device modified from that shown in FIGS. 1 and 2.

Turning now to FIG. 4, there is shown a beer dispensing system which is substantially the same as the soft drink dispensing system. Specifically it comprises a pair of beer kegs 63 from which beer is dispensed under pressure from compressed through supply lines 64. The beer is dispensed past a valve 65 through product supply lines 66 to a holding tank 67. From the holding tank 67 the beer is dispensed via the conventional beer tap 68.

The sanitizing system in this arrangement includes the tank 60, the cover plate 40 and the lines 58 and 59 permanently connected to a gas supply and a water supply respectively. In this case the gas is compressed air rather than carbon dioxide and the water is plain water rather than soda water.

In this case the manifold previously indicated at 44 and in this embodiment indicated at 441 is modified in that it includes only two connectors 502 which are of the spigot type rather than the quick release type. The spigot type connectors 502 are connected to lines 503 which can be connected to the product lines 66 downstream of the valve 65. Two further connectors 504 are merely dummies that is they are not connected to the manifold 441 and are there to receive the quick release connectors 505 on the ends of the lines 503. The dummy connectors 504 are used merely as storage for the couplings 505 to ensure that they are kept in a sanitary condition.

The process previously described in relation to the soft drink dispensing system is then carried out in relation to the beer dispensing system. The only modification is that instead of the sanitizing tank being permanently connected to the air supply it is connected to the air supply at the manifold 52 by a connecting hose 69.

In further modifications of the manifold device which are not shown, the number of connectors 49, 50 are attached to the manifold 44 can be increased up to seven to accommodate dispensing heads having seven different dispensing nozzles. In addition the quick release connectors 49, 50, 56 are illustrated, as will be apparent to one skilled in the art, as the type used by most soft drink dispensing companies but it will of course be apparent that the coupling can be modified to accommodate other types of cooperating connector and particularly that used for Coke (Trade Mark).

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative and not in a limiting sense.

I claim:

1. A manifold device for use in sanitizing a drink supply system comprising a support member, means for attaching said support member to a support, a manifold carried by said support member and including a plurality of quick release couplings each for receiving a cooperating coupling of a supply hose, a hose with one end thereof connected to said manifold, a quick release coupling mounted on the other end of the hose, and a pair of quick release couplings mounted on said support member separate from said manifold, each connected to a hose connector for receiving the end of a supply hose and each arranged to cooperate with the cooperating coupling on the other end of the hose.

2. The invention according to claim 1 wherein the quick release couplings are all identical and each is adapted to receive a cooperating coupling from either a compressed gas supply line or a product supply line.

3. The invention according to claim 1 wherein the quick release couplings each are associated with a respective one of a plurality of indicia indicating particular products within the product supply containers.

4. The invention according to claim 1 wherein the attaching means is arranged for attaching the support member to a planar support, said quick release couplings being arranged on said support member so as to project away from said planar support.

5. The invention according to claim 4 wherein the hose connectors extend parallel to the planar support.

6. The invention according to claim 4 wherein the support member comprises two planar surfaces inclined relative to the planar support and toward one another with said quick release couplings projecting outwardly from said planar surfaces at right angles thereto.

7. The invention according to claim 6 including a further planar surface parallel to the planar support and connecting the planar surfaces, a quick release coupling projecting outwardly therefrom at right angles thereto.

8. A manifold device for use in sanitizing a drink supply system comprising a support member, means for attaching said support member to a support, a manifold carried by said support member and including a plurality of quick release couplings each for receiving a cooperating coupling of a supply hose with one end thereof connected to said manifold, a cooperating coupling mounted on the other end of the hose, and at least one quick release coupling mounted on said support member separate from said manifold connected to a hose connector for receiving the end of a supply hose and arranged to cooperate with the coupling on the other end of the hose, said attaching means being arranged for attaching the support member to a planar support, said quick release couplings being arranged on said support member so as to project away from said planar support.

9. The invention according to claim 8 wherein the hose connectors extend parallel to the planar support.

10. The invention according to claim 8 wherein the quick release couplings are all identical and each is adapted to receive a cooperating coupling from either a compressed gas supply line or a product supply line.

11. The invention according to claim 8 wherein the support member comprises two planar surfaces inclined relative to the planar support and toward one another with said quick release couplings projecting outwardly from said planar surfaces at right angles thereto.

12. The invention according to claim 11 including a further planar surface parallel to the planar support and connecting the planar surfaces, a quick release coupling projecting outwardly therefrom at right angles thereto.

13. A manifold device for use in sanitizing a drink supply system comprising a cylindrical manifold having a polygonal cross section defining a plurality of planar sides, a support member for supporting said manifold, consisting of a plate bent along the lines parallel to the longitudinal axis of the manifold so as to form sides of the plate which contact and lie parallel to respective sides of the manifold and so as to form flanges parallel to the axis arranged at respective opposed edges of the sides for engaging a planar support surface whereby the plate can be supported with said sides presented forwardly from the surface and said manifold supported rearwardly thereof adjacent said surface, a plurality of quick release coupling means mounted on said manifold so as to extend forwardly from said sides of the plate, a hose with one end thereof connected to said manifold, a quick release coupling on the other end of the hose and at least one quick release coupling mounted on one of said sides of said plate separate from said manifold connected to a hose connector for receiving the end of a supply hose and arranged to cooperate with the coupling on the other end of the hose.

14. The invention according to claim 13 including two quick release couplings each mounted on a respective one of said sides of said plate, each connected to a hose connector for receiving the end of a supply hose and each arranged to cooperate with the coupling on the other end of the hose.

15. The invention according to claim 13 wherein said manifold is hexagonal in cross section and wherein said plate includes three sides bent at respective angles of 60°, a central one of the sides having a width equal to a width of one side of the manifold so that the manifold engages the central side and the other two sides in said parallel relation, said other sides being wider than the corresponding side of the manifold so as to provide an area free from said manifold for supporting said side mounted quick release coupling.

16. The invention according to claim 13 wherein said plate is attached to said manifold by said coupling means.

* * * * *